US011195682B2

(12) United States Patent
Stifter, Jr. et al.

(10) Patent No.: US 11,195,682 B2
(45) Date of Patent: Dec. 7, 2021

(54) CIRCUIT INTERRUPTER, TRIP DECK ASSEMBLY, AND SUPPORT FOR SWITCH THEREFOR

(71) Applicant: EATON CORPORATION, Cleveland, OH (US)

(72) Inventors: Frank Joseph Stifter, Jr., Bridgeville, PA (US); Sunnybhai Patel, Chicago, IL (US); Jonathan M. Peifer, Pittsburgh, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 455 days.

(21) Appl. No.: 15/714,009

(22) Filed: Sep. 25, 2017

(65) Prior Publication Data

US 2019/0096620 A1 Mar. 28, 2019

(51) Int. Cl.

| | |
|---|---|
| ***H01H 73/12*** | (2006.01) |
| ***H01H 83/12*** | (2006.01) |
| ***H01H 71/04*** | (2006.01) |
| ***H01H 71/46*** | (2006.01) |
| ***H01H 1/22*** | (2006.01) |
| ***H01H 71/02*** | (2006.01) |

(Continued)

(52) U.S. Cl.

CPC ..... *H01H 83/12* (2013.01); *H01H 1/226* (2013.01); *H01H 71/0228* (2013.01); *H01H 71/04* (2013.01); *H01H 71/1009* (2013.01); *H01H 71/465* (2013.01); *H01H 73/12* (2013.01); *H01H 83/20* (2013.01); *H01H 2071/1036* (2013.01)

(58) Field of Classification Search

CPC ..... H01H 71/322

USPC ..... 335/172–176

See application file for complete search history.

(56) References Cited

U.S. PATENT DOCUMENTS 1,296,636 A * 3/1919 De Guire ..... H01H 71/322 335/174

3,760,307 A * 9/1973 Patel ..... H01H 51/10 335/13

(Continued)

FOREIGN PATENT DOCUMENTS

EP 1 643 527 A2 4/2006

OTHER PUBLICATIONS

European Patent Office, "International Search Report and Written Opinion" (corresp. to PCT/IB18/056884), dated Sep. 10, 2018, 11 pp.

*Primary Examiner* — Alexander Talpalatski

(74) *Attorney, Agent, or Firm* — Eckert Seamans Cherin & Mellott, LLC

(57) ABSTRACT

An improved multi-pole circuit interrupter includes an improved trip deck assembly adjacent one pole and further includes an accessory deck adjacent another pole. The accessory deck includes conventional accessory devices such as an auxiliary switch, etc., and the trip deck assembly includes switches and one or more other devices that can interact with a crossbar and a trip bar of the circuit interrupter. Such switches can be easily installed by a technician in the field after manufacture of the circuit interrupter. One switch is held in place by a support, and the other switch is held in place by a retainer, with the support and the retainer holding the switches in a fixed position on the trip deck assembly in order to interact with the crossbar and the trip bar.

5 Claims, 5 Drawing Sheets

(51) Int. Cl.
*H01H 71/10* (2006.01)
*H01H 83/20* (2006.01)

(56) References Cited

U.S. PATENT DOCUMENTS

| | | | | | |
|---|---|---|---|---|---|
| 4,097,831 | A * | 6/1978 | Jencks | H01H 71/1072 | 335/166 |
| 5,894,257 | A * | 4/1999 | Roger | H01H 71/2463 | 335/172 |
| 6,362,445 | B1 * | 3/2002 | Marchand | H02B 13/0354 | 218/155 |
| 6,768,404 | B2 * | 7/2004 | Ojeda | H01H 71/7463 | 335/175 |
| 6,980,071 | B2 * | 12/2005 | Kumar | H01H 71/7463 | 335/172 |
| 7,570,140 | B2 * | 8/2009 | Helms | H01H 71/2463 | 335/172 |
| 7,733,199 | B2 * | 6/2010 | Dauer | H01H 71/56 | 335/18 |
| 2002/0117387 | A1 | 8/2002 | Castonguay et al. | | |
| 2007/0194869 | A1 | 8/2007 | Titus | | |

* cited by examiner

CIRCUIT INTERRUPTER, TRIP DECK ASSEMBLY, AND SUPPORT FOR SWITCH THEREFOR

BACKGROUND

Field

The disclosed and claimed concept relates generally to circuit interruption equipment and, more particularly, to a circuit interrupter, a trip deck assembly of the circuit interrupter, and a support for carrying a switch of the trip deck assembly.

Related Art

Numerous types of circuit interrupters are known in the relevant art. Circuit interrupters are known to be used in order to protect at least a portion of a circuit from certain predetermined electrical conditions such as overcurrent conditions, under-voltage conditions, and other such conditions. Some circuit interrupters are single pole circuit interrupters whereas others circuit interrupters simultaneously interrupt a plurality of poles. Some circuit interrupters include a trip bar which, when moved in response to any of a variety of events, actuates an operating mechanism that separates a set of separable contacts. In a multi-pole circuit interrupter, a crossbar is typically provided across the sets of separable contacts of each pole to cause all of the sets of separable contacts to open simultaneously in response to operation of the operating mechanism.

It is also known to provide certain instrumentation on circuit interrupters. By way of example, it is known to provide accessory devices such as bell alarms, auxiliary switches, shunt trips, under-voltage relays, and the like that perform various functions in a known fashion. It is also known, however, that it can be desirable to have as much instrumentation as possible inside a breaker, including redundant instrumentation if possible, but that the space within the interior of a circuit interrupter for such instrumentation is limited. Improvements thus would be desirable.

SUMMARY

An improved multi-pole circuit interrupter includes an improved trip deck assembly adjacent one pole and further includes an accessory deck adjacent another pole. The accessory deck includes conventional accessory devices such as an auxiliary switch, etc., and the trip deck assembly includes switches and one or more other devices that can interact with a crossbar and a trip bar of the circuit interrupter. Such switches can be easily installed by a technician in the field after manufacture of the circuit interrupter. One switch is held in place by a support, and the other switch is held in place by a retainer, with the support and the retainer holding the switches in a fixed position on the trip deck assembly in order to interact with the crossbar and the trip bar.

Accordingly, an aspect of the disclosed and claimed concept is to provide an improved support that can hold a switch in position with respect to a crossbar of a circuit interrupter.

Another aspect of the disclosed and claimed concept is to provide a trip deck assembly that can carry such a support and a switch on a circuit interrupter.

Another aspect of the disclosed and claimed concept is to provide a circuit interrupter having such a trip deck assembly and such a support that holds the switch.

Accordingly, an aspect of the disclosed and claimed is to provide an improved support for a switch that is structured to mount the switch to a platform, the switch having a housing and further having a plunger that is movably situated on the housing. The support can be generally stated as including a base structured to engage the housing, the base having an opening formed therein that is structured to receive therethrough at least a portion of at least one of the housing and the plunger, a number of walls situated on the base, a mounting apparatus that is structured to be usable to affix the number of walls to the platform, and a receptacle that is situated adjacent the base and the number of walls and that is structured to receive the housing therein.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
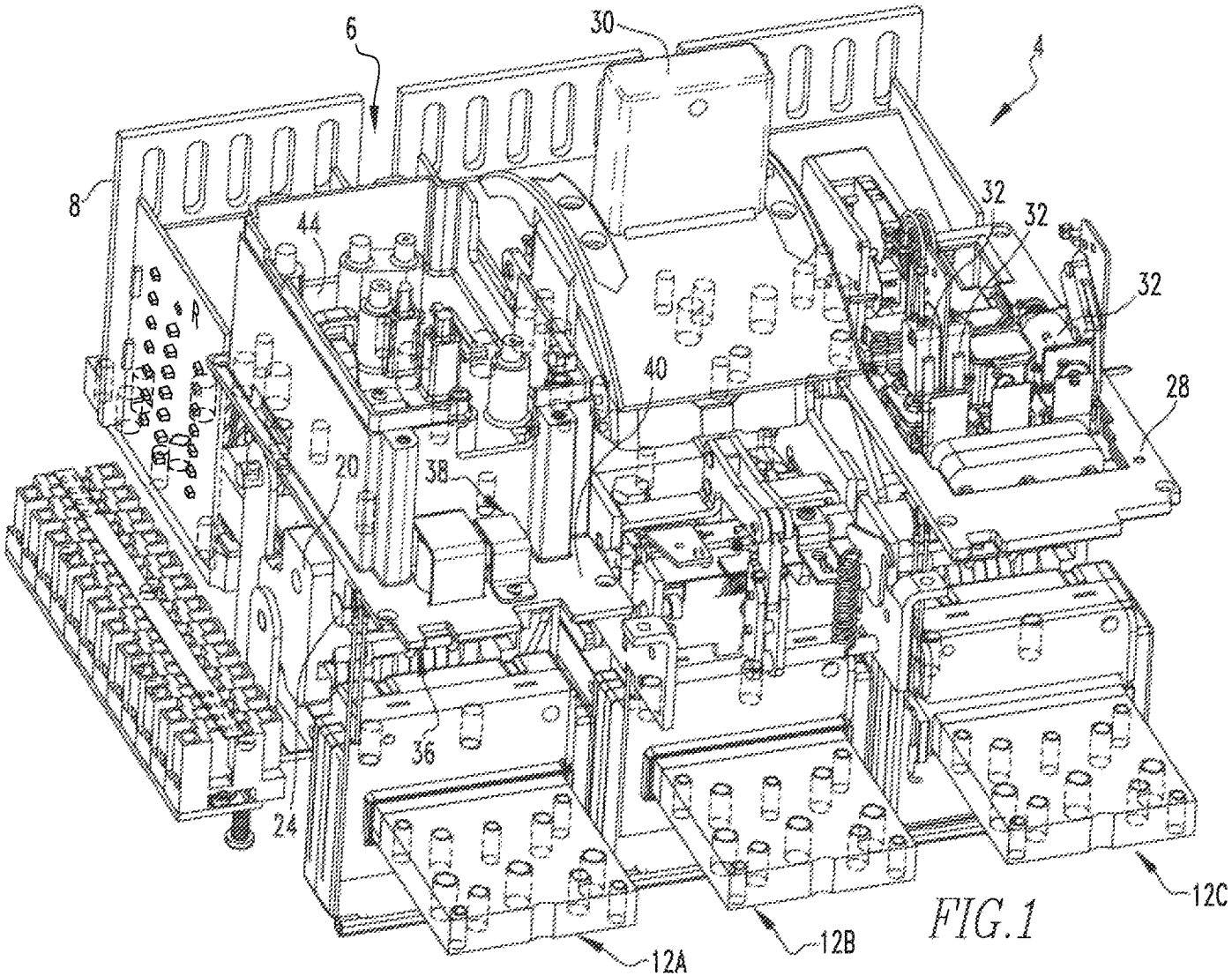
FIG. 1 is a perspective view of an improved circuit interrupter in accordance with the disclosed and claimed concept.

An improved circuit interrupter 4 in accordance with the disclosed and claimed concept is depicted generally in FIG. 1. The circuit interrupter 4 includes a trip deck assembly 6 that likewise in accordance with the disclosed and claimed concept. The circuit interrupter 4 includes a frame 8, and the trip deck assembly 6 is situated on the frame 8.

The circuit interrupter 4 additionally includes a plurality of poles 12A, 12B, and 12C, which may be collectively or individually referred to herein with the numeral 12. Each of the poles 12 includes a set of separable contacts (FIG. 2) that typically can be stated as each including a line contact and a load contact that are electrically connected with line and load conductors, respectively, of the circuit interrupter 4. The sets of separable contacts of the poles 12A, 12B, and 12C are indicated at the numerals 16A, 16B, and 16C, respectively, and which may be collectively or individually referred to herein with the numeral 16.

Figure 2:
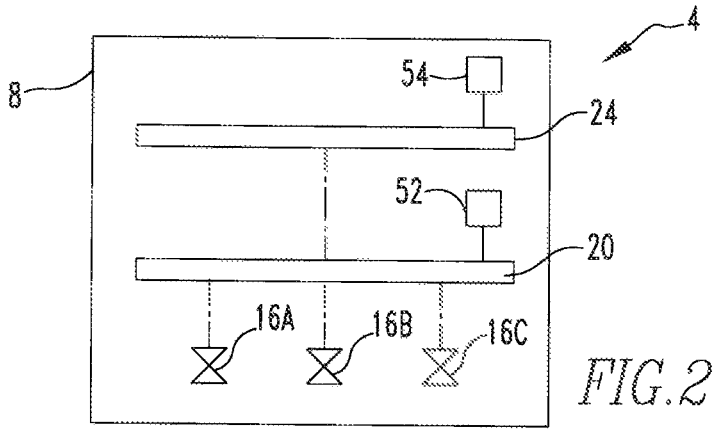
FIG. 2 is a schematic depiction of the circuit interrupter of FIG. 1.
Figure 5:
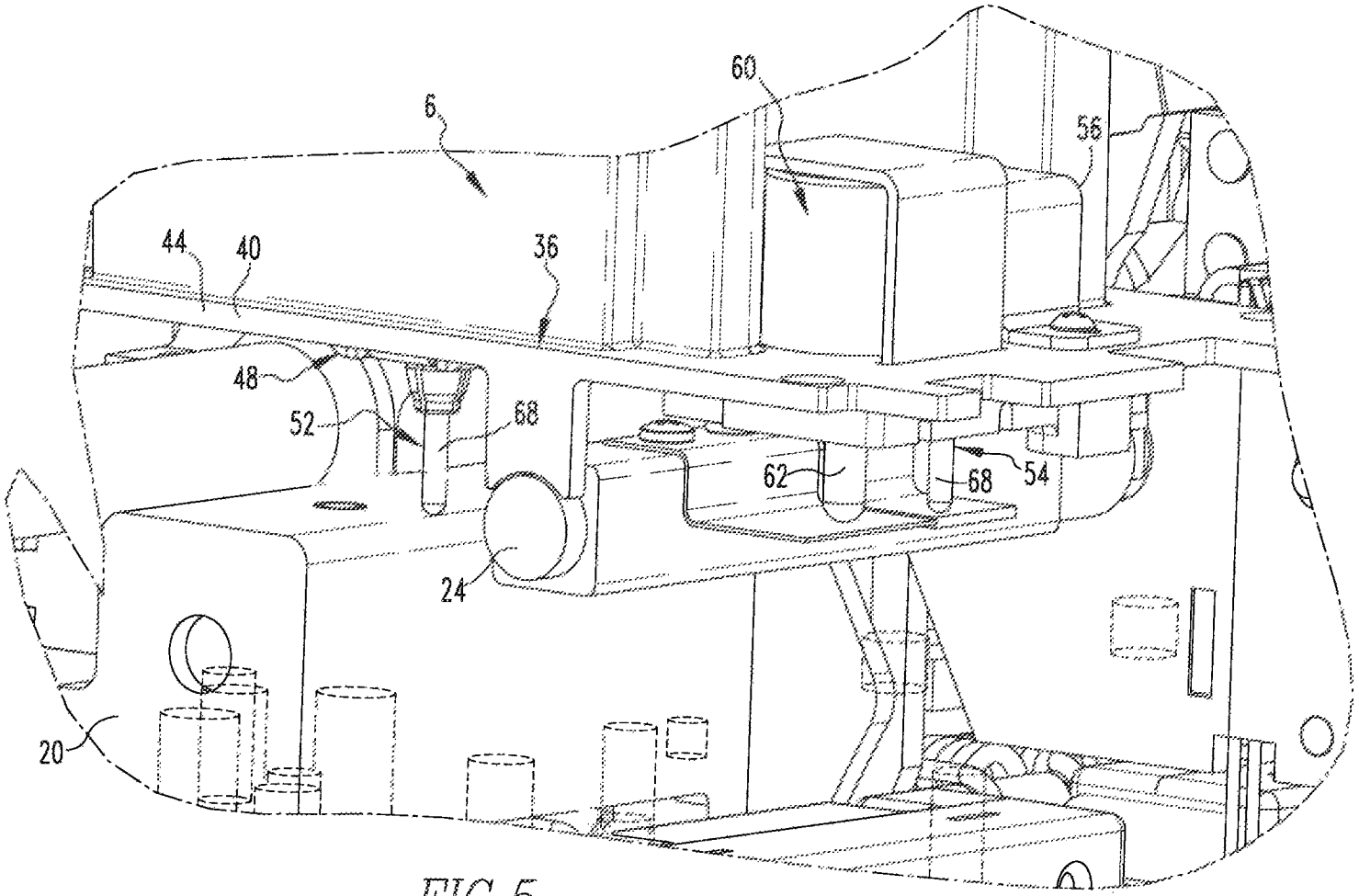
FIG. 5 is a perspective side view of a portion of the trip deck assembly and the circuit interrupter of FIG. 1.

The circuit interrupter 4 further includes a crossbar 20 and a trip bar 24 that are depicted schematically in FIG. 2 and that are depicted in greater detail in FIG. 5. In a known fashion, the crossbar 20 is operably connected with each of the sets of separable contacts 16, and the trip bar 24 is operably connected with the crossbar 20 to cause the crossbar 20 to rotate about its axis of elongation and to cause the sets of separable contacts 16 to move between a CLOSED state and an OPEN state. The circuit interrupter 4 further includes an accessory deck 28 that is situated on the frame 8 adjacent the pole 12C. As can be seen in FIG. 1, the aforementioned trip deck assembly 6 is situated on the frame 8 adjacent the pole 12A. The circuit interrupter 4 further includes an operating handle 30 that is situated adjacent the pole 12B and thus is situated generally between the trip deck assembly 6 and the accessory deck 28. The accessory deck 28 has a number of accessory devices 32 situated thereon. As employed herein, the expression "a number of" and variations thereof shall refer broadly to any non-zero quantity, including a quantity of one. The accessory devices 32 can include any one or more of an auxiliary switch, a bell alarm, a shunt trip, an under-voltage relay, and/or any other type of accessory without limitation.

The trip deck assembly 6 can be said to include a platform apparatus 36 and a switch apparatus 38. The platform apparatus 36 includes a platform 40 upon which the switch apparatus 38 is situated. The platform apparatus further includes a processing system 44 that is generically depicted as being situated somewhere on the platform 40, although it is understood that the processing system 44 can be situated anywhere on the trip deck assembly 6 without departing from the spirit of the instant disclosure. As will be set forth in greater detail below, the switch apparatus 38 is electrically connected with the processing system 44. The processing system 44 is electrically connected with another electronic device such as a mainframe computer, an enterprise data system, or with other electronic components of the circuit interrupter 4, by way of example and without limitation.

Figure 3:
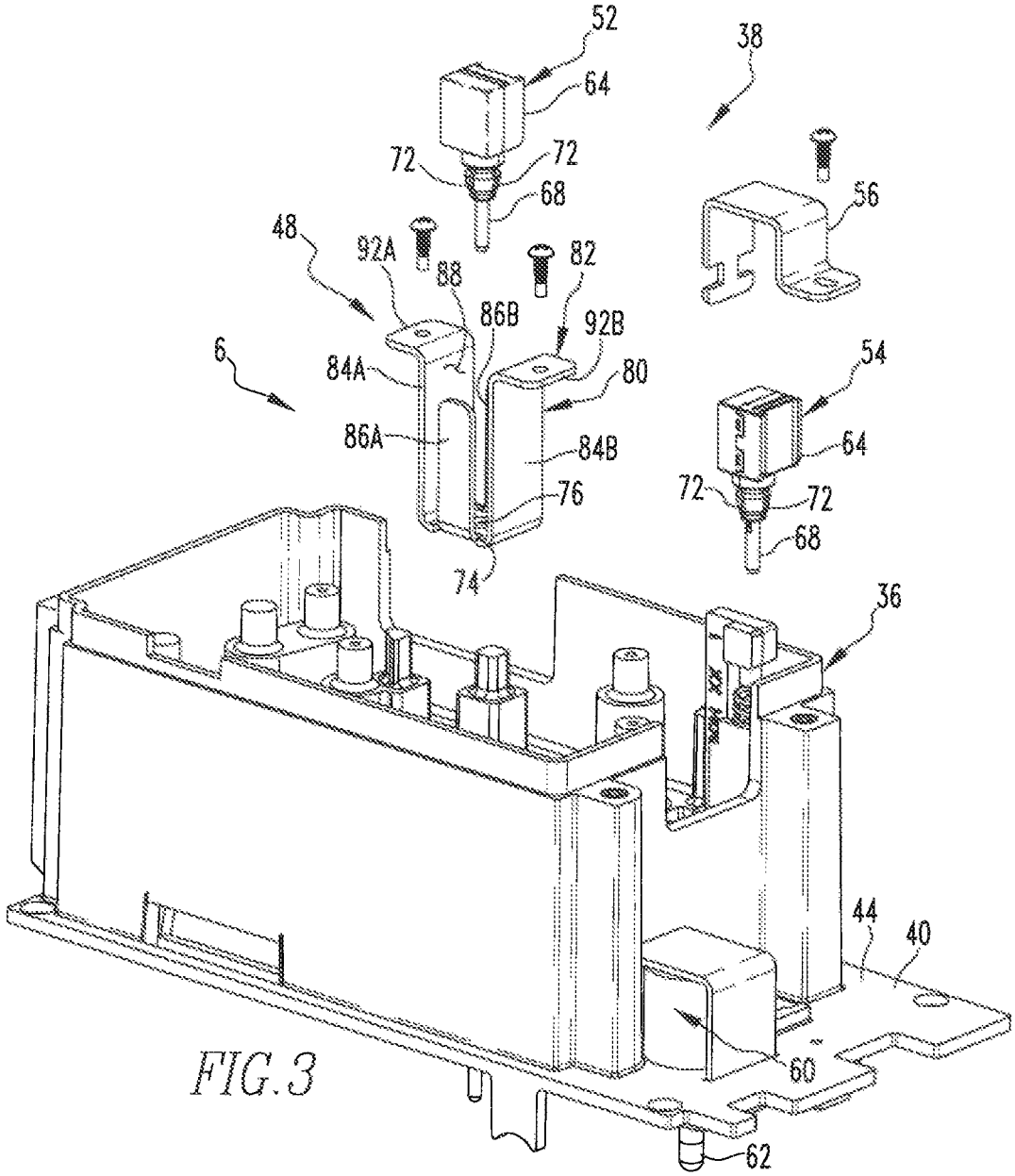
FIG. 3 is an exploded view of an improved trip deck assembly of the circuit interrupter of FIG. 1 in accordance with the disclosed and claimed concept.

As can be understood from FIG. 3, the switch apparatus 38 includes a support 48 that holds affixed thereon a switch 52. The support 48 with the switch 52 situated thereon is mountable to the platform 40 with the use of a pair of screws. The switch apparatus 38 further includes another switch 54 that is receivable on the platform 40 and that is held in place by a retainer 56 that is mounted to the platform 40 with another screw. The platform apparatus 36 further includes a trip actuator 60 situated thereon that includes an actuation element 62. As will set forth in greater detail below, the actuation element 62 is engageable with the trip bar 24 to initiate a trip of the circuit interrupter 4.

As can be understood from FIG. 3, the switches 52 and 54 each include a housing 62 and a plunger 68. Each plunger 68 is movably situated on the housing 64 and is movable between a first state and a second state that are different than one another. In one of the first and second states, the switches 52 and 54 are in a CLOSED condition, and in the other of the first and second states, the switches 52 and 54 are in an OPEN condition. The switches 52 and 54 further each include a plurality of elastically deformable lugs 72 that are situated on the housing 64 adjacent the plunger 68 and which are engageable with another structure of the circuit interrupter 4 to retain the switches 52 and 54 in a fixed position on the circuit interrupter 4.

Figure 4:
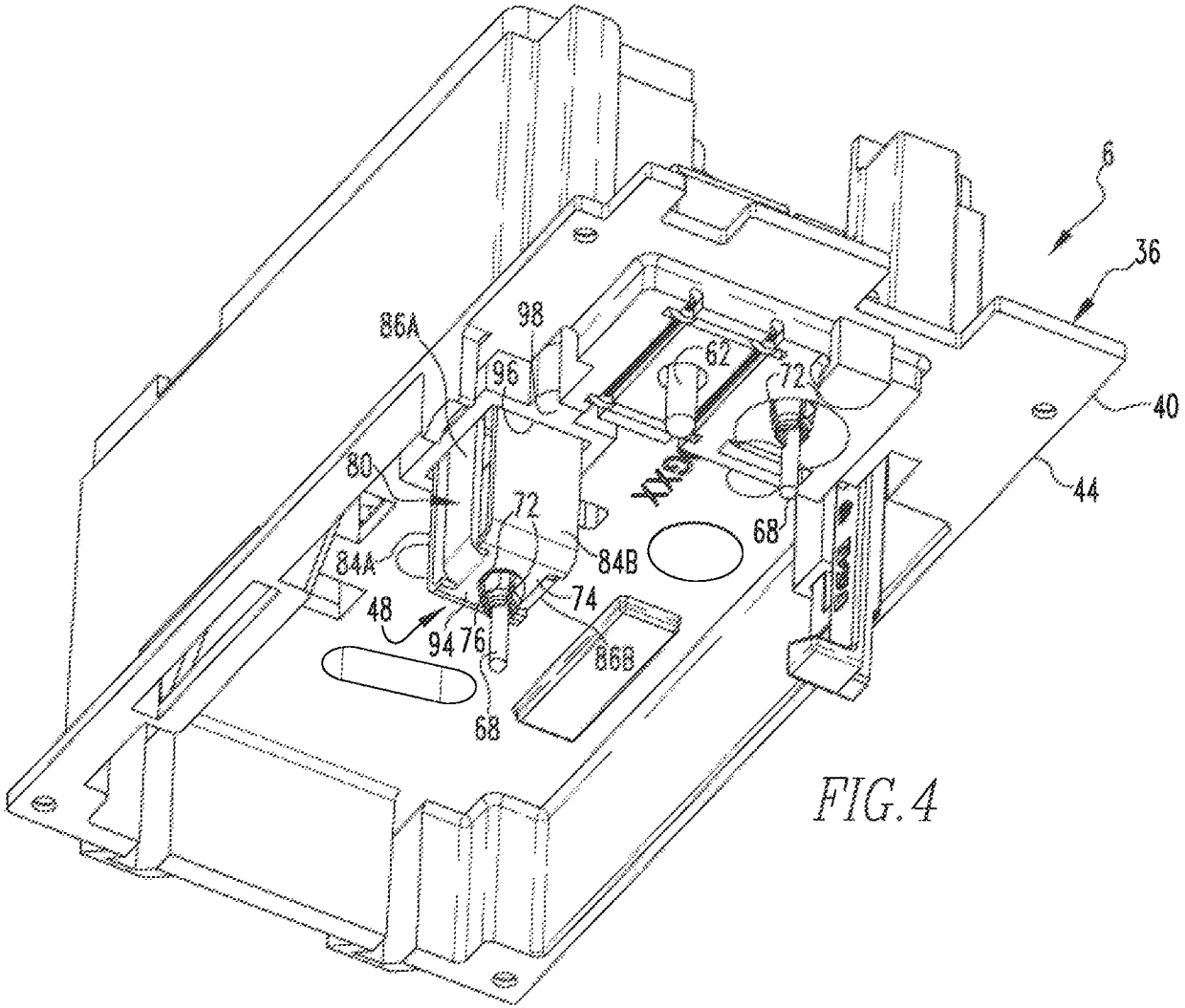
FIG. 4 is a perspective view of the underside of the trip deck of FIG. 3.

As can be understood from FIGS. 3 and 4, the support 48 can be said to include a base 74 having an opening 76 formed therein and to further include a number of walls 80 situated on the base 74. The housing 64 additionally includes a mounting apparatus 82 (FIG. 3) situated on the number of walls 80. The number of walls 80 can be said to include a pair of end walls 84A and 84B and to further include a pair of side walls 86A and 86B. The housing 64 can be said to also include a receptacle 88 that is situated adjacent and that is generally bounded by the base 74, the end walls 84A and 84B, and the side walls 86A and 86B. The mounting apparatus 82 includes a pair of tabs 92A and 92B that are situated at the ends of the side walls 86A and 86B, respectively, opposite the base 74. The tabs 92A and 92B extend from the side walls 86A and 86B in opposite directions away from one another and generally away from the receptacle 88.

As can further be understood from FIGS. 3 and 4, the switch 52 is receivable on the support 48 by receiving the plunger 68 and the lugs 72 in the opening 76 with an interference fit such that the lugs 72 are engaged with the base 74 on a surface 94 (FIG. 4) thereof opposite the end walls 84A and 84B and the side walls 86A and 86B and which retains the switch 52 in a fixed position on the support 48. The support 48 with the switch 52 mounted thereon is then received in a hole 96 (FIG. 4) that is formed in the platform 40 until the tabs 92A and 92B engage an upper surface of the platform 40 adjacent the hole 96. The screws are received in a pair of mounts 98 that are situated generally at opposite sides of the hole 96, with one of mounts 98 being depicted in FIG. 4. Such mounting of the support 48 with the switch 52 situated thereon to the platform 40 affixes the support 48 and the switch 52 in a fixed position on the circuit interrupter 4 since the platform 40 is affixed to the frame 8.

Figure 6:
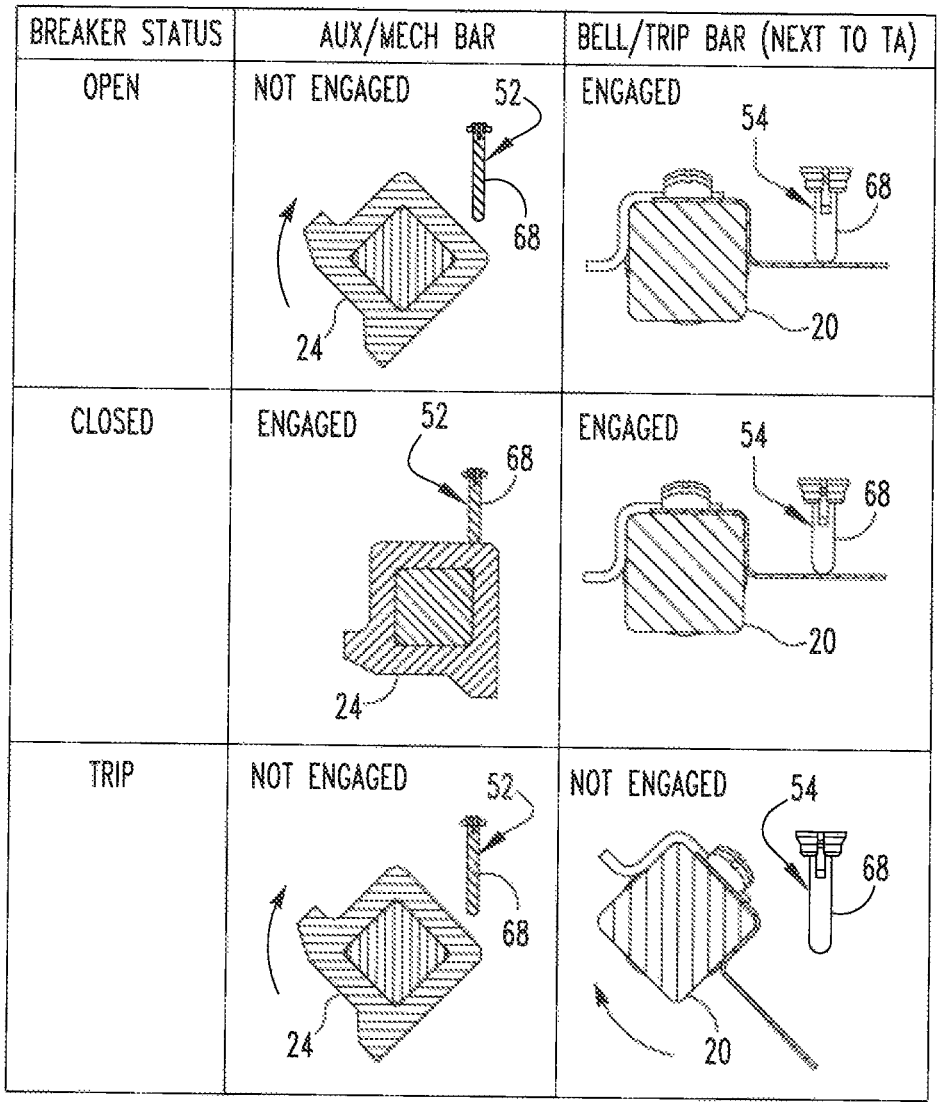
FIG. 6 depicts a number of possible positions of a crossbar and a trip bar of the circuit interrupter of FIG. 1 in association with a pair of switches of the trip deck assembly.

As noted elsewhere herein, the switches 52 and 54 are electrically connected with the processing system 44. As can be seen in FIG. 5, the plungers 68 of the switches 52 and 54 are engageable with the crossbar 20 and the trip bar 24, respectively. In this regard, it is understood that the crossbar 20 and the trip bar 24 are each pivotable about their respective axis of elongation as the circuit interrupter 4 moves among an OPEN position, a CLOSED position, and a TRIP position, such as is depicted generally in FIG. 6. FIG. 5 depicts the crossbar 20 and the trip bar 24, as well as the switches 52 and 54 when the circuit interrupter 4 is in its CLOSED position. In such a situation, the plungers 68 can each be said to be in their first state, which is depicted herein as being a compressed state slightly retracted into the housing 64 as a result of engagement with the crossbar 20 and the trip bar 24, respectively. It can further be seen from FIG. 6, however, that in the OPEN position of the circuit interrupter 4, the crossbar 20 has been rotated sufficiently to cause the plunger 68 of the switch 52 to be in its second state while the switch 54 remains in its first state. Furthermore, it can further be seen from FIG. 6 that in the TRIP position, both the crossbar 20 and the trip bar 24 have rotated from what had been their orientations in the CLOSED position such that in the TRIP position the plungers 68 of both of the switches 52 and 54 are in their second states.

The first and second states of the plungers 68 of the switches 52 and 54 are detected by or are otherwise communicated to the processing system 44, and based upon which the processing system 44 generates an output from which other data devices can discern whether the circuit interrupter 4 is in its OPEN position, its CLOSED position, or its TRIP position. This information is provided in addition to any information that may be provided by any of the accessory devices 32 on the accessory deck 28. Such redundant information is highly advantageous due to the potential for structures to fail when the circuit interrupter 4 is tripped. Furthermore, the trip deck assembly 6 is situated at an end of the circuit breaker 4 opposite the accessory deck 28 and thus does not occupy any space that otherwise would be occupied by the accessory deck 28. Furthermore, and as noted above, the switch apparatus 38 can be retrofitted to the circuit breaker 4 in the field after manufacture, meaning that the circuit interrupter 4 can be manufactured without the switch apparatus 38 and potentially without the trip deck assembly 6, and that either or both can be added in the field with minimal effort, which is highly advantageous. Further advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. A combination comprising: a support; and a switch; the support being structured to mount the switch to a platform; the switch having a housing and further having a plunger that is movably situated on the housing to change the switch between a first state and a second state; the support comprising: a base engaged with the housing, the base having an opening formed therein receives therethrough at least a portion of at least one of the housing and the plunger; a number of walls situated on the base; a mounting apparatus that is structured to be usable to affix the number of walls to the platform; and a receptacle that is situated adjacent the base and the number of walls and that receives the housing therein; the trip deck assembly being structured to be usable with a circuit interrupter having a plurality of poles, a crossbar, and a trip bar, the circuit interrupter being movable among a plurality of conditions that include an ON condition, an OFF condition, and a TRIPPED condition, the trip deck assembly further comprising:

a platform apparatus upon which the mounting apparatus is situated, the platform apparatus being, structured to be affixed to the circuit interrupter;

the plunger being structured to be in a first position engaged with the crossbar to cause the switch to be in its first state in the ON condition, the plunger being structured to be in a second position different from first position to cause the switch to be in its second state in the OFF condition and the TRIPPED condition; and another switch disposed on the platform apparatus and having another housing and further having another plunger that is movably situated on the another housing to change the another switch between a first state and a second state, the another plunger being structured to be in a first position engaged with the trip bar to cause the another switch to be in its first state in the ON condition and the OFF condition, the another plunger being structured to be in a second position different from first position to cause the another switch to be in its second state in the TRIPPED condition.

2. The trip deck assembly of claim 1 wherein the platform apparatus comprises a processing system with which the switch and the another switch are electrically connected, the processing system being structured to generate an output depending upon whether the switch is in its first state or its second state and further depending upon whether the another switch is in its first state or its second state.

3. The trip deck assembly of claim 1 wherein the platform apparatus further comprises a trip actuator structured to operatively engaged the trip bar in a number of predetermined conditions.

4. A circuit interrupter comprising the rip deck assembly of claim 1, the circuit interrupter further comprising:

a frame;

a plurality of poles situated on the frame and each comprising a set of separable contacts;

a crossbar situated on, the frame and operatively connected with each set of separable contacts; and a trip bar situated on the frame and operatively connected with the crossbar;

the circuit interrupter being movable among a plurality of conditions that include an ON condition, an OFF condition, and a TRIPPED condition;

the plunger being in the first position engaged with the crossbar to cause the switch to be in its first state in the ON condition, the plunger being in the second position to cause the switch to be in its second state in the OFF condition and the TRIPPED condition; and the another plunger being in the first position engaged with the trip bar to cause the another switch to be in its first state in the ON condition and the OFF condition, the another plunger being in the second position to cause the another switch to be in its second state in the TRIPPED condition.

5. The circuit interrupter of claim 4, wherein the frame comprises an accessory deck situated adjacent a pole of the plurality of poles, the accessory deck being structured to have a number of accessory devices mounted thereon, and wherein the trip deck assembly is situated on the frame adjacent another pole of the plurality of poles.

* * * * *